US008821179B2

(12) United States Patent
Yang

(10) Patent No.: US 8,821,179 B2
(45) Date of Patent: Sep. 2, 2014

(54) CLAMP MECHANISM FOR CLAMPING A CABLE

(75) Inventor: Chun-Fei Yang, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 69 days.

(21) Appl. No.: 13/607,837

(22) Filed: Sep. 10, 2012

(65) Prior Publication Data

US 2013/0164964 A1 Jun. 27, 2013

(30) Foreign Application Priority Data

Dec. 21, 2011 (TW) ..... 100147721 A

(51) Int. Cl.
*H01R 4/50* (2006.01)
*H01R 13/625* (2006.01)

(52) U.S. Cl.
USPC ..... 439/345; 439/67

(58) Field of Classification Search
CPC .... H01R 13/6275; H01R 12/62; H05K 3/365; H05K 1/118
USPC ..... 439/345, 67, 77, 329
See application file for complete search history.

(56) References Cited

U.S. PATENT DOCUMENTS

| | | | | |
|---|---|---|---|---|
| 2,928,063 | A * | 3/1960 | Gammel, Sr. | 439/329 |
| 4,770,645 | A * | 9/1988 | Antes | 439/329 |
| 5,899,757 | A * | 5/1999 | Neidich et al. | 439/67 |
| 6,254,406 | B1 | 7/2001 | Chiu | |
| 6,676,444 | B2 * | 1/2004 | Noro | 439/579 |
| 6,863,559 | B2 * | 3/2005 | Yu | 439/497 |
| 6,991,473 | B1 * | 1/2006 | Balcome et al. | 439/67 |
| 7,354,300 | B2 * | 4/2008 | Shindo | 439/497 |
| 7,530,815 | B2 * | 5/2009 | Ju | 439/67 |
| 7,628,618 | B2 * | 12/2009 | Wang et al. | 439/67 |
| 2007/0066142 | A1 | 3/2007 | Shindo | |

FOREIGN PATENT DOCUMENTS

| | | |
|---|---|---|
| TW | 409999 | 10/2000 |
| TW | M353501 | 3/2009 |
| TW | M367448 U1 | 10/2009 |
| TW | I351794 | 11/2011 |

OTHER PUBLICATIONS

Office action mailed on Feb. 27, 2014 for the Taiwan application No. 100147721, filing date: Dec. 21, 2011, p. 2 line 3~26, p. 3 and p. 4 line 1~18.

* cited by examiner

*Primary Examiner* — Hae Moon Hyeon
(74) *Attorney, Agent, or Firm* — Winston Hsu; Scott Margo

(57) ABSTRACT

A clamp mechanism for clamping a cable on a circuit board is disclosed in the present invention. The clamp mechanism includes a base disposed on the circuit board. The cable can be accommodated inside the base. The clamp mechanism further includes a clamping portion disposed on the base in a resiliently deformable manner. The clamping portion moves away from the circuit board when the cable is accommodated inside the base, and a resilient recovering force generated by the resilient deformation simultaneously drives the clamping portion to press the cable, so as to constrain a movement of the cable relative to the base.

10 Claims, 5 Drawing Sheets

CLAMP MECHANISM FOR CLAMPING A CABLE

BACKGROUND OF THE INVENTION

1. Field of the Invention

The present invention relates to a clamp mechanism, and more particularly, to a clamp mechanism for fixing a cable on a circuit board.

2. Description of the Prior Art

A conventional cable clamp mechanism includes a base and a pressing portion, the pressing portion is disposed on the base in a pivotable manner. As assembling the cable, the pressing portion is manually driven to pivot relative to the base at an open position, so as to enlarge an opening of the base. Then the cable is inserted into the base through the opening, and the pressing portion is rotated from the open position to a close position, so as to press a surface of the cable for preventing the cable from separating from the base. The conventional cable clamp mechanism has drawbacks of complicated structure, expensive manufacturing cost and long assembly period. The pressing portion of the conventional cable clamp mechanism is movably disposed on the base, so the pressing portion is abraded easily by external force that results in low manufacturing yield of the product. Thus, design of a cable clamp mechanism having simple structure, low manufacturing cost and easy operation is an important issue in the mechanical industry.

SUMMARY OF THE INVENTION

The present invention provides clamp mechanism for fixing a cable on a circuit board for solving above drawbacks.

According to the invention, a clamp mechanism includes a base disposed on a circuit board, and a clamping portion disposed on the base in a resiliently deformable manner. A cable is accommodated inside the base. The clamping portion is bent relative to the base and separated from the circuit board when the cable is accommodated inside the base, and a resilient recovering force generated by resilient deformation drives the clamping portion to press the cable, so as to constrain a movement of the cable relative to the base.

According to the invention, the clamp mechanism further includes a conductive component disposed inside the base. The clamping portion presses the cable so that a connecting end of the cable contacts the conductive component.

According to the invention, the clamping portion includes a fixing end integrated with the base monolithically, and a movable end suspended above the circuit board. A distance between the movable end and the circuit board is substantially smaller than a thickness of the cable.

According to the invention, the clamping portion further includes an inclined structure disposed on the movable end.

According to the invention, the clamp mechanism further includes a plurality of clamping portions separately disposed on an edge of the base in the resiliently deformable manner. Each clamping portion is a hook structure, and a movable end of the hook structure presses a surface of the cable when the cable moves relative to the base.

According to the invention, the movable end of the hook structure is a curved hook or a slap-shaped hook.

According to the invention, the base and the clamping portion are respectively made of metal material with resiliently deformable property.

According to the invention, the base is fixed on the circuit board by surface mount technology.

According to the invention, the clamp mechanism further includes a buckling portion disposed by a side of the base. A hole is formed on a surface of the circuit board, and the buckling portion buckles into the hole to constrain a movement of the base relative to the circuit board.

According to the invention, a fixing hole is formed on a side of the base, and a hole is formed on a surface of the circuit board. A fixing component pierces through the fixing hole and the hole to fix the base on a boss, so as to constrain a movement of the base relative to the circuit board.

The clamp mechanism of the present invention has simple structure, and can be assembled and disassembled rapidly without structural destruction. In addition, the clamp mechanism of the present invention has advantages of low cost and easy operation, so as to effectively increase the manufacturing yield of the product, and to speed the manufacturing period for enhancing market competition.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
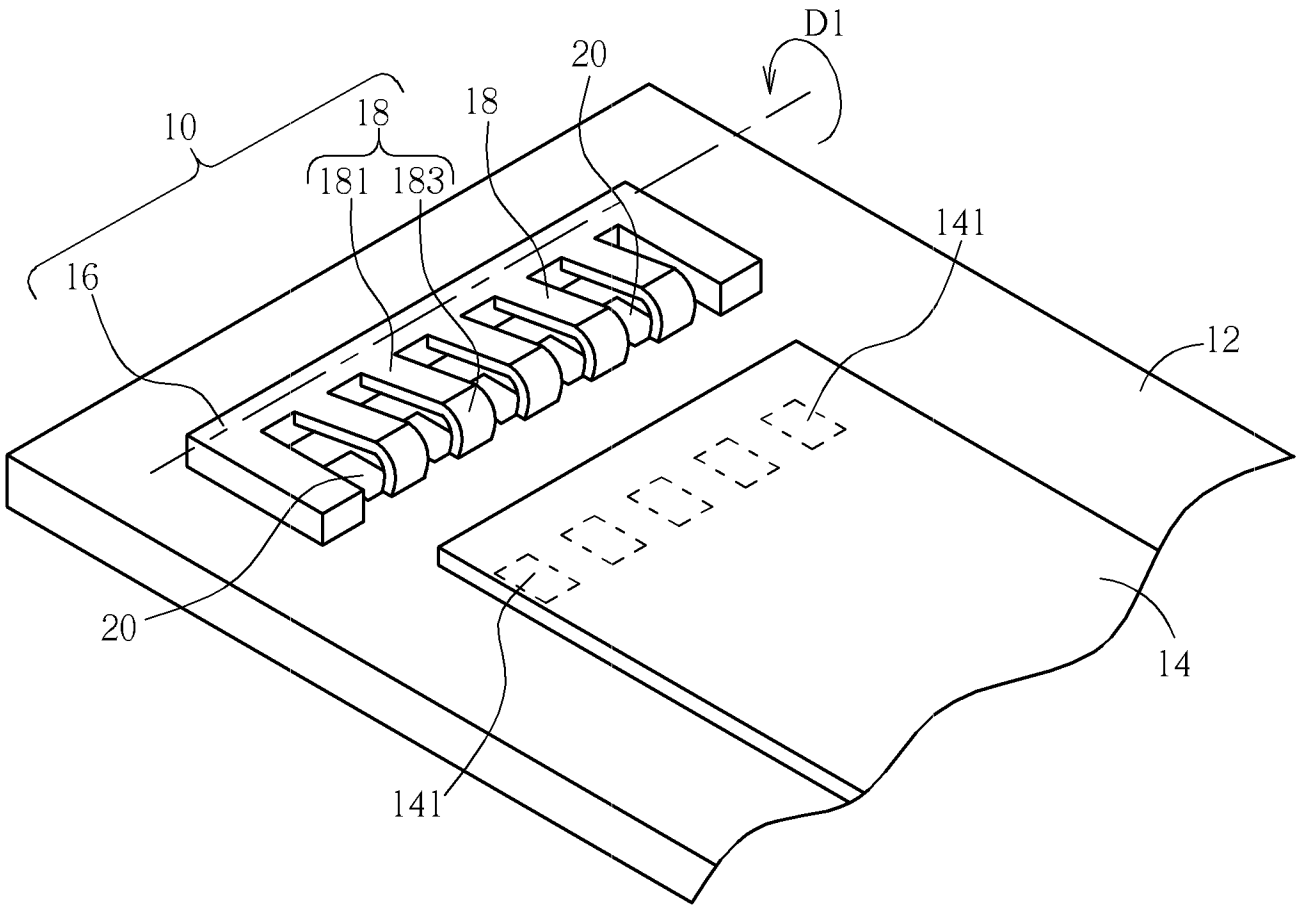
FIG. 1 is a diagram of a clamp mechanism according to a first embodiment of the present invention.

Please refer to FIG. 1, a diagram of a clamp mechanism 10 according to a first embodiment of the present invention. The clamp mechanism 10 can be disposed on a circuit board 12 for fixing a cable 14, so as to constrain a movement of the cable 14 relative to the circuit board 12. Generally, the cable 14 can be a flex flat cable (FFC) or a flexible circuit (FPC). The clamp mechanism 10 of the present invention can press on a surface of the cable 14 to steady the cable 14 on the circuit board 12.

The clamp mechanism 10 can include a base 16 and a plurality of clamping portions 18. The base 16 is disposed on the circuit board 12. The cable 14 can slide relative to the circuit board 12 and be partly accommodated inside the base 16. For example, the base 16 can be a U-shaped structure. An inner space of the U-shaped structure surrounds an end of the cable 14. The plurality of clamping portions 18 is separately disposed on an edge of the base 16 adjacent to the inner of the U-shaped structure in a resiliently deformable manner, so as to form a hook structure and to uniformly press the corresponding positions of the cable 14. The clamp mechanism 10 further includes one clamping portion 18 connected to the base 16 in a resiliently deformable manner. The clamping portion 18 presses the surface of the cable 14 when the cable 14 is accommodated inside the base 16. An amount and structure of the clamping portion correspond to actual demand, and detail description is omitted herein for simplicity.

As shown in FIG. 1, each clamping portion 18 includes a fixing end 181 and a movable end 183. The fixing end 181 is integrated with the edge of the base 16 monolithically, and the movable end 183 is suspended above the circuit board 12. Because a distance between the movable end 183 and the circuit board 12 is substantially smaller than a thickness of the cable 14, the cable 14 push each clamping portion 18 to bend relative to the base 16 along a first direction Dl to separate the movable end 183 from the circuit board 12 (or to move the movable end 183 out of the inner of the base 16) when the cable 14 is inserted into the base 16, so as to enlarge the distance between the movable end 183 and the circuit board 12, and the cable 14 can move into the base 16 smoothly. In the embodiment of the present invention, the base 16 and the clamping portions 18 are respectively made of metal material with resiliently deformable property. When the cable 14 moves into the base 16 and bends the clamping portions 18, a resilient recovering force generated by resilient deformation rotates the clamping portions 18 along a direction opposite to the first direction D1, so that the clamping portions 18 keeps pressing the cable 14 to constrain the movement of the cable 14 relative to the base 16 and the circuit board 12.

To press and attach the clamping portion 18 on the surface of the cable 14 uniformly and steady, the clamping portion 18 is designed as a hook structure, and the movable end 183 of the hook structure points at a direction of the circuit board 12. The movable end 183 is a curved hook or a slab-shaped hook selectively, and an inclined structure is disposed on a front of the hook. The movable end 183 is located at an opening of the base 16 (an opening of the U-shaped structure) when the cable 14 is not accommodated inside the base 16. As assembling the cable 14 inside the base 16, the cable 14 is driven to slide on the surface of the circuit board 12 and to move into the base 16. Meanwhile, the inclined structure of the movable end 183 slides relative to the cable 14, and bends the clamping portion 18 relative to the base 16 along the first direction D1, so as to enlarge the distance between the movable end 183 and the circuit board 12 for releasing a constraint of the clamping portion 18 and the cable 14. Then, the movable end 183 of the clamping portion 18 presses the surface of the cable 14 by its own resilient recovering force due to the resilient deformation of the clamping portion 18 relative to the base 16, so as to prevent the cable 14 from separating from the base 16, and to constrain the movement of the cable 14 relative to the base 16 and the circuit board 12.

Furthermore, the clamp mechanism 10 further includes a plurality of conductive components 20 selectively. The conductive components 20 are respectively disposed inside the base 16 and electrically connected to the circuit board 12. When the cable 14 is fixed by the clamp mechanism 10, the clamping portion 18 press on an upper surface of the cable 14, so that the plurality of connecting ends 141 disposed on a low surface of the cable 14 tightly contact the corresponding conductive component 20 for electrical connection. Thus, the clamp mechanism 10 fix the cable 14 on the circuit board 12 for signal transmission.

Figure 2:
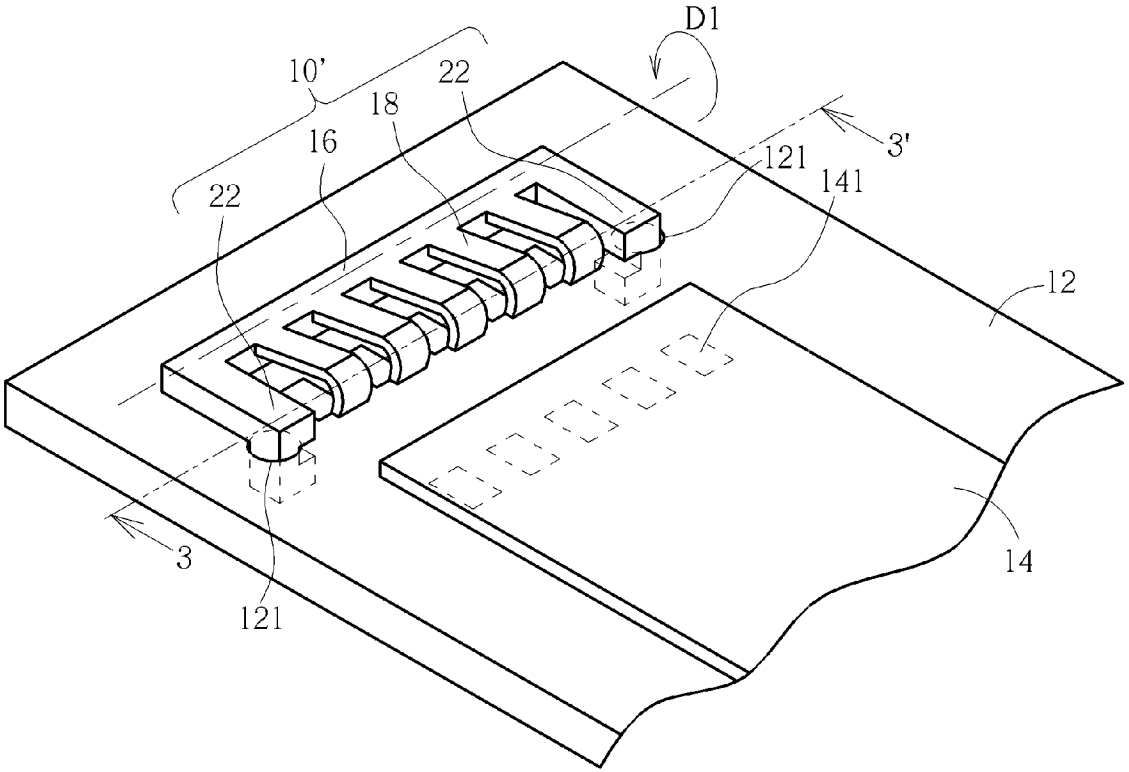
FIG. 2 is a diagram of a clamp mechanism according to a second embodiment of the present invention.
Figure 3:
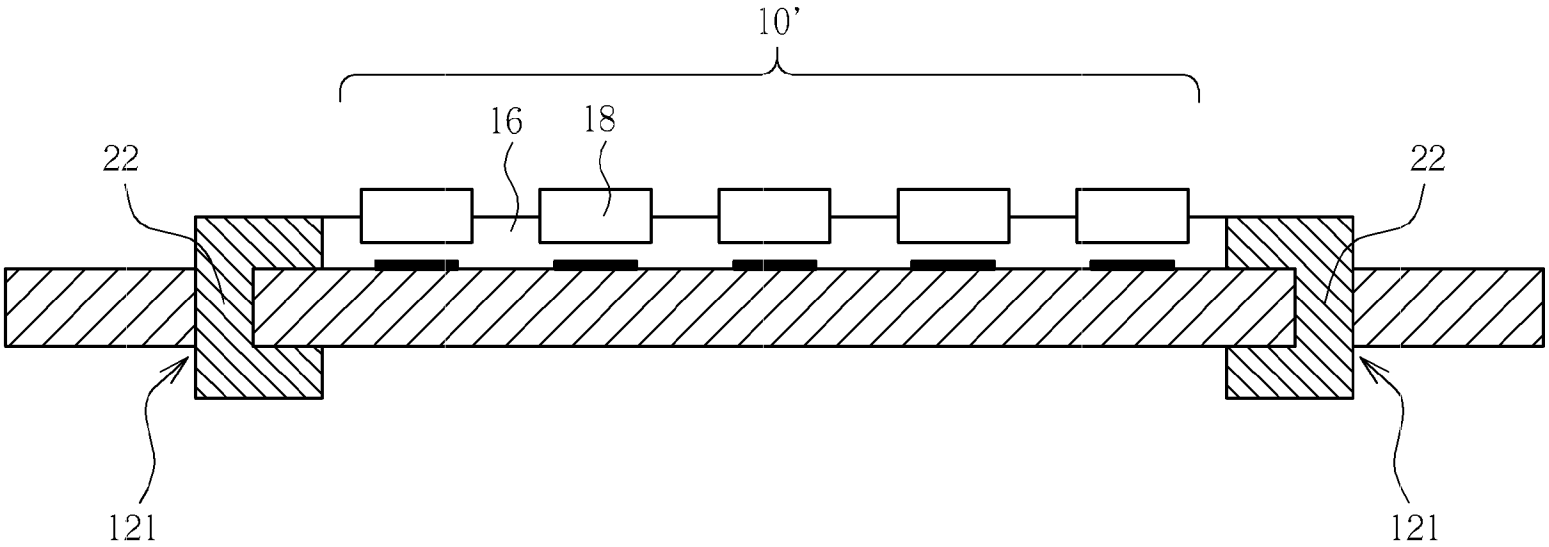
FIG. 3 is a sectional view of the clamp mechanism according to the second embodiment of the present invention.
Figure 4:
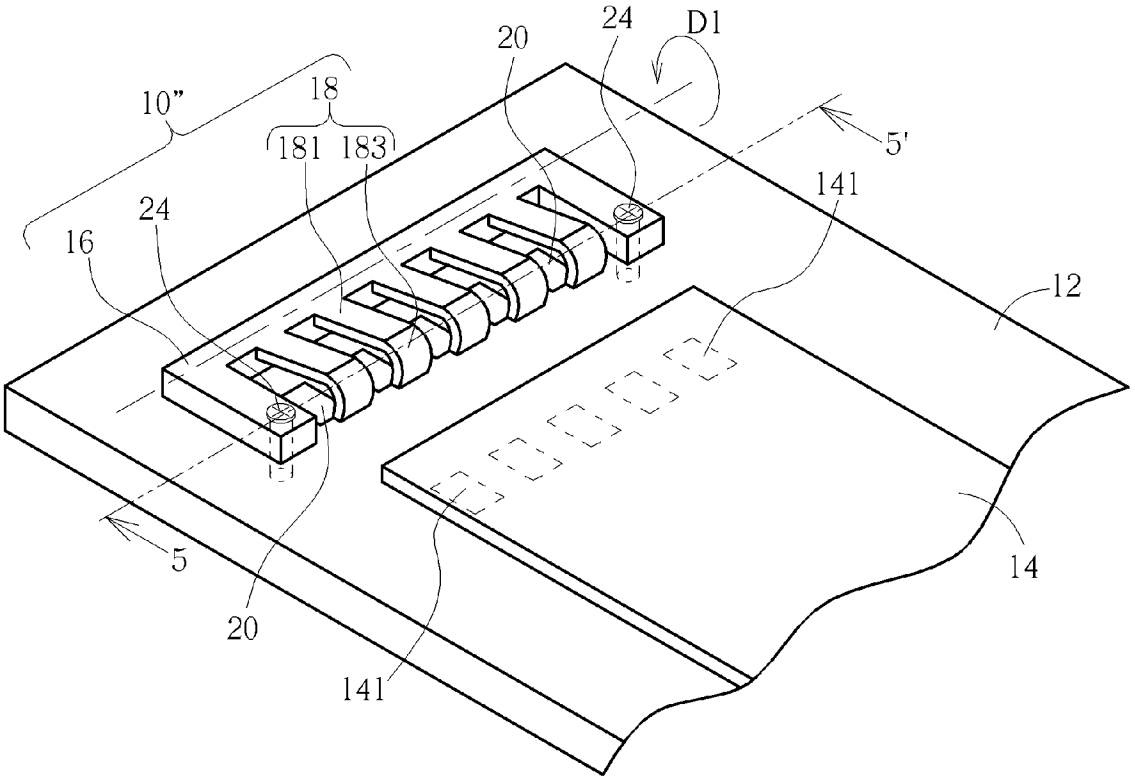
FIG. 4 is a diagram of a clamp mechanism according to a third embodiment of the present invention.
Figure 5:
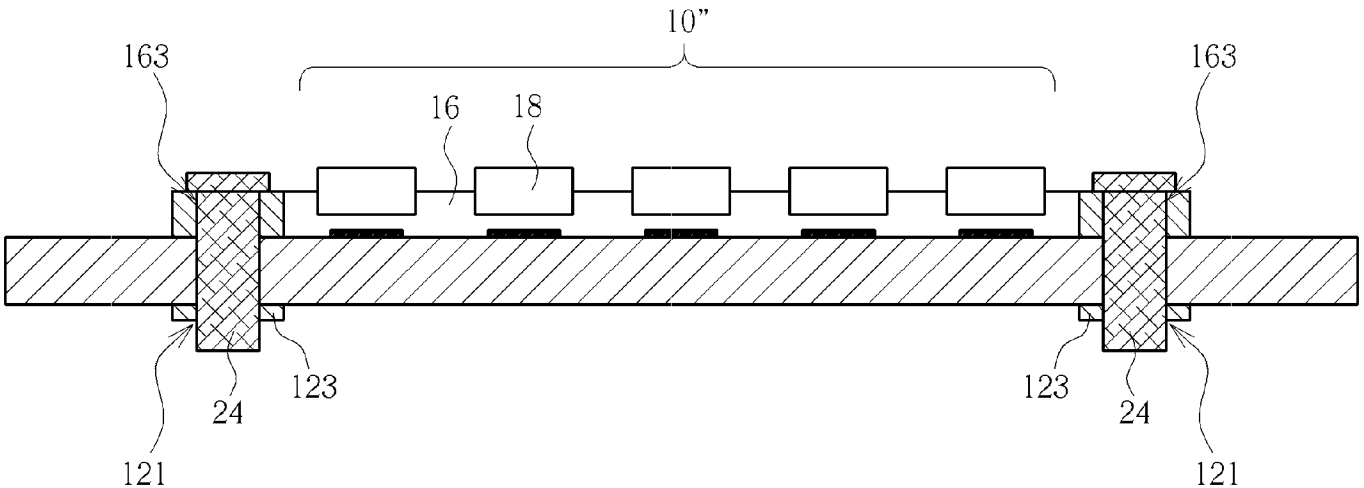
FIG. 5 is a sectional view of the clamp mechanism according to the third embodiment of the present invention.

In the first embodiment, the clamp mechanism 10 is disposed on the circuit board 12 by surface mount technology. However the clamp mechanism 10 can also be disposed on the circuit board 12 by the other technology. Please refer to FIG. 2 to FIG. 5. FIG. 2 is a diagram of a clamp mechanism 10' according to a second embodiment of the present invention. FIG. 3 is a sectional view of the clamp mechanism 10' according to the second embodiment of the present invention. FIG. 4 is a diagram of a clamp mechanism 10" according to a third embodiment of the present invention. FIG. 5 is a sectional view of the clamp mechanism 10" according to the third embodiment of the present invention. In the second embodiment and the third embodiment, elements having the same numerals as ones of the first embodiment have the same structures and functions, and detail description is omitted herein for simplicity.

As shown in FIG. 2 and FIG. 3, the clamp mechanism 10' of the second embodiment further includes two buckling portions 22 respectively disposed by two sides of the base 16. Two holes 121 formed on the surface of the circuit board 12. Each buckling portion 22 buckles into the corresponding hole 121 for constraining the movement of the base 16 relative to the circuit board 12. As shown in FIG. 4 and FIG. 5, the clamp mechanism 10" of the third embodiment forms two fixing holes 163 on two sides of the base 16. Two fixing component 24, such as the screws or the bolts, is utilized to pierce through the fixing holes 163 and the hole 121, and to lock into a boss 123 of the circuit board 12 for constraining the movement of the base 16 relative to the circuit board 12.

In conclusion, the clamp mechanism of the present invention includes the clamping portion integrated with the base monolithically. At an initial state, an inclination angle of the clamping portion relative to the base is designed under a predetermined range, and the clamping portion can be interfered with the cable within the predetermined range when the cable is inserted into the base. A user can exert pressure upon the cable to overcome material stress of the clamp mechanism as inserting the cable into the base, so as to bend the clamping portion relative to the base for releasing the above-mentioned constraint. After the cable is inserted into the base, the resilient recovering force by the resilient deformation can drive the clamping portion to tightly press the surface of the cable, so as to constrain the movement of the cable relative to the base for clamp operation.

Comparing to the prior art, the clamp mechanism of the present invention has simple structure, which can be assembled and disassembled rapidly without structural destruction. In addition, the clamp mechanism of the present invention has advantages of low cost and easy operation, so as to effectively increase the manufacturing yield of the product, and to speed the manufacturing period for enhancing market competition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A clamp mechanism comprising:

a base disposed on a circuit board, a cable being accommodated inside the base; and a plurality of clamping portions respectively integrated with the base monolithically in a resiliently deformable manner, a fixing end of each clamping portion being pivotally bent relative to the base and a movable end of the each clamping portion being separated from the circuit board when the cable is accommodated inside the base, and a resilient recovering force generated by resilient deformation driving the other end of the each clamping portion to press the cable, so as to constrain a movement of the cable relative to the base.

2. The clamp mechanism of claim 1, further comprising:

a conductive component disposed inside the base, the plurality of clamping portions pressing the cable so that a connecting end of the cable contacts the conductive component.

3. The clamp mechanism of claim 1, wherein the fixing end of each clamping portion is integrated with the base monolithically, and the movable end of each clamping portion is suspended above the circuit board, wherein a distance between the movable end and the circuit board is substantially smaller than a thickness of the cable.

4. The clamp mechanism of claim 3, wherein each clamping portion further comprises an inclined structure disposed on the movable end.

5. The clamp mechanism of claim 1, wherein the plurality of clamping portions is separately disposed on an edge of the base in the resiliently deformable manner, each clamping portion is a hook structure, and a movable end of the hook structure presses a surface of the cable when the cable moves relative to the base.

6. The clamp mechanism of claim 5, wherein the movable end of the hook structure is a curved hook or a slap-shaped hook.

7. The clamp mechanism of claim 1, wherein the base and each clamping portion are respectively made of metal material with resiliently deformable property.

8. The clamp mechanism of claim 1, wherein the base is fixed on the circuit board by surface mount technology.

9. The clamp mechanism of claim 1, wherein the clamp mechanism further comprises a buckling portion disposed by a side of the base, a hole is formed on a surface of the circuit board, the buckling portion buckles into the hole to constrain a movement of the base relative to the circuit board.

10. The clamp mechanism of claim 1, wherein a fixing hole is formed on a side of the base, a hole is formed on a surface of the circuit board, a fixing component pierces through the fixing hole and the hole to fix the base on a boss of the circuit board, so as to constrain a movement of the base relative to the circuit board.

* * * * *